United States Patent [19]

Harada

[11] Patent Number: 5,019,830

[45] Date of Patent: May 28, 1991

[54] AMPLIFIED FM ANTENNA WITH PARALLEL RADIATOR AND GROUND PLANE

[75] Inventor: Takuji Harada, Hiratsuka, Japan

[73] Assignee: Harada Kogyo Kabushiki Kaisha, Tokyo, Japan

[21] Appl. No.: 311,238

[22] Filed: Mar. 13, 1989

[51] Int. Cl.[5] ..... H01Q 1/26; H01Q 9/16

[52] U.S. Cl. ..... 343/701; 343/713; 343/752; 343/791; 343/793; 343/830; 343/905; 455/291

[58] Field of Search ..... 343/701, 702, 711–713, 343/790–792, 741, 825, 828, 830, 850, 905, 752, 793; 455/269, 270, 274, 280–282, 287, 292

[56] References Cited

U.S. PATENT DOCUMENTS 930,746 8/1909 Eisenstein ..... 343/752
3,521,169 7/1970 Turner et al. ..... 343/701
3,622,890 11/1971 Fujimoto et al. ..... 343/701
3,725,940 4/1973 Siple ..... 343/713
3,845,488 10/1974 Jones et al. ..... 343/792
4,602,260 7/1986 Lindenmeier et al. ..... 343/701

*Primary Examiner*—Michael C. Wimer

[57] ABSTRACT

An FM wave antenna including a coaxial cable, a parallel conductor which are provided parallel to a metal conductor such as a vehicle body and an amplifier provided between the coaxial cable and the parallel conductor. The coaxial cable is made up of a central core and inductive outer sheath and one end of the inductive outer sheath is connected to the metal conductor, and one end of the parallel conductor is also connected to the metal conductor. The amplifier amplifies signals from the parallel conductor and inductive outer sheath of the coaxial cable and outputs amplified signals to the central core of the coaxial cable.

12 Claims, 2 Drawing Sheets

FIG. 1
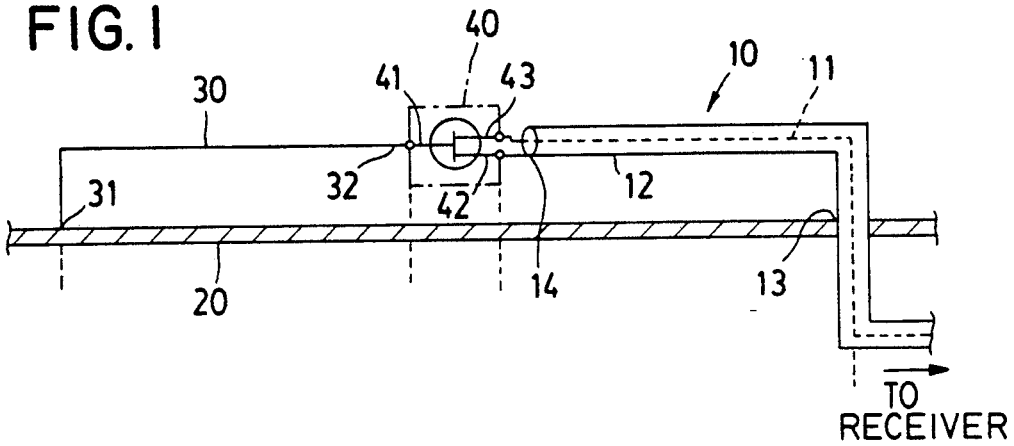
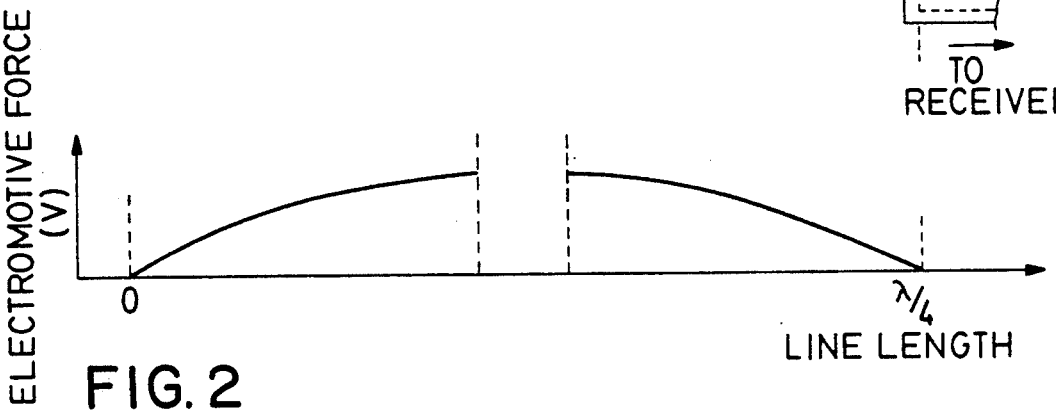
FIG. 2
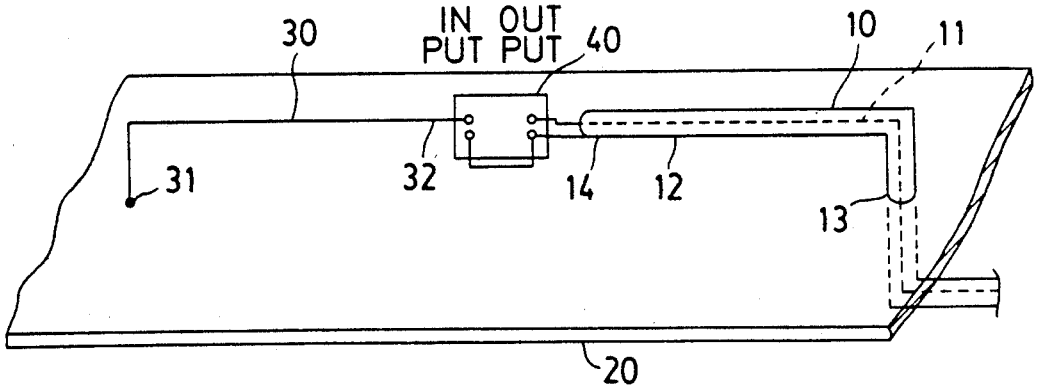
FIG. 3

AMPLIFIED FM ANTENNA WITH PARALLEL RADIATOR AND GROUND PLANE

BACKGROUND OF THE INVENTION

1. Field of the Invention

The present invention relates to an FM antenna and more particularly to an FM wave receiving antenna.

2. Prior Art

In prior art, metal rod type antennas and linear folding type antennas have been used for automobile FM wave antennas and demountable FM broadcast receiving antennas. When antenna gain should be considered, antennas having wavelengths of $\frac{1}{2}$ to $\frac{1}{4}$ are most preferable, because the receiving level is abruptly reduced if the antenna has shorter wavelength. For this reason, antennas of 80 cm or longer have been mostly used in Japan.

In antennas for frequencies above the VHF band, the rod type antenna and folding line type antenna have $\frac{1}{4}$ wavelength or multiples thereof in whole numbers. Such antennas are usually too long. Accordingly, shortening devices such as coils are put in the antenna. However the shortening of the length results in sacrificing some gain. Thus, the shortening of antenna length involves some limitations.

Plate form antennas are occasionally used as electrostatic antennas. However, in order to obtain a sufficient gain, metal plates of as large surface area as 300 $cm^2$ are required.

Furthermore, in automobiles, it is preferred not to have any projected objects on the vehicle body in view of design preference and in order to avoid noises which they would make when the car is in motion. No conventional antennas could have met these demands. Antennas for indoor equipment and those incorporated in receivers, on the other hand, are formed flat so that they lay against the attached surface of the equipment, and receivers are required to be as unobtrusive as possible for esthetic reasons and harmony of indoor environments. However conventional antennas are not satisfactory in this area, either.

SUMMARY OF THE INVENTION

Accordingly, it is a primary object of the present invention to provide an FM wave antenna which does not project from surfaces of receivers and automobiles and stays low on such surfaces.

According to the FM wave antenna of the present invention, a coaxial line comprising a central core and an inductive outer sheath is installed substantially parallel to the surface of a metal conductor, and one end of the inductive outer sheath is connected to the metal conductor. A parallel conductor is installed also substantially parallel to the metal conductor, and one end of the parallel conductor is connected to the metal conductor. An amplifier is provided between the coaxial line and the parallel conductor. Thus, the signal from the parallel conductor and the inductive outer sheath of the coaxial line are amplified by the amplifier and outputted to the central core of the coaxial line. Thus, the FM wave antenna mounted on an intended surface does not project and stay flat on the metal conductor which can be an automobile body.

BRIEF DESCRIPTION OF THE DRAWINGS

FIG. 3 is a perspective view of the antenna of FIG. 1;

DETAILED DESCRIPTION OF THE INVENTION

Figures 1, 4:
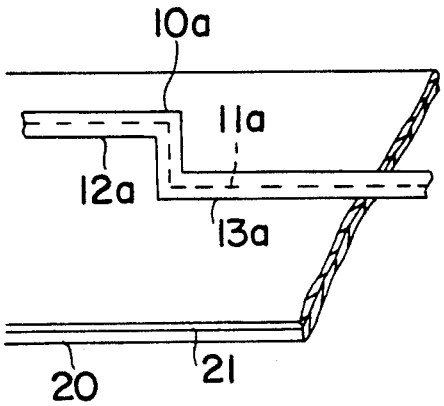
FIG. 1 is a longitudinal sectional view of an antenna according to the present invention.
FIGS. 4(1) and 4(2) show another embodiment of the present invention.

In FIG. 1, a coaxial line 10 inlcudes a central core 11 and an outer sheath 12. The central core 11 and the outer sheath 12 are separated by an insulator (now shown). The coaxial line 10 is provided substantially parallel to the surface of a metal conductor 20, and one end of the outer sheath 12 is connected to the metal conductor 20.

A parallel conductor 30 is provided also substantially parallel to the metal conductor 20, and one end 31 of this parallel conductor 30 is connected to the metal conductor 20.

An amplifier 40 amplifies signals which are sent through the parallel conductor 30 and the outer sheath 12 of the coaxial line 10. The signals thus amplified by the amplifier 40 are outputted to the central core 11 of the coaxial line 10.

In particular, the amplifier 40 is an FET (field effect transistor). Other amplifying means can be used as the amplifier 40. An end 32 of the parallel conductor 30 is connected to a gate 41 of the amplifier or FET 40. A source 42 of the FET 40 is connected to the end 14 of the outer sheath 12, and a drain 43 of the FET 40 is connected to the central core 11.

The distance between the end 31 of the parallel conductor 30 and the end 13 of the outer sheath 12 of the coaxial line 10 is set approximately at $\lambda/4$ in this embodiment.

Figures 2, 4:
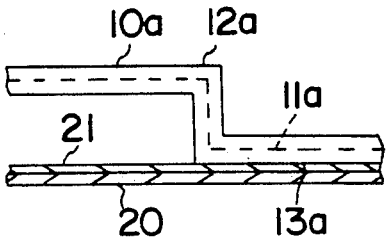
FIG. 2 illustrates an electromotive force of the antenna of FIG. 1.

FIG. 2 shows electromotive force with respect to the line length of the above-described embodiment, and FIG. 3 is a perspective view of the antenna of FIG. 1.

Operation of the embodiment will be described below.

First of all, when a conductor is set parallel to a metal plate and one end of the conductor is grounded, the impedance of the other end of the conductor usually repeats cycles of high and low voltages at every $\lambda/4$ length as the length of the conductor is changed. Accordingly, if a high point of this cycle is selected, an induced voltage from the high frequency electrical field in a space can be increased. Furthermore, if open ends of two conductors are set face to face on a metal plate, the potentials between the open ends can be doubled.

The reason for such potentials to be doubled between the open ends of two conductors can be described such that a signal from the parallel conductor 30 in the above embodiment and a signal from the outer sheath 12 are in a reverse voltage relationship. For example, when the gate signal is positive with respect to the ground which is the metal conductor 20, the source signal with respect to the ground or the metal conductor 20 becomes negative.

Meanwhile, the inner surface of the outer sheath 12, in cooperation with the central core 11, forms a reference potential at the output side of the amplifier 40.

If the outer sheath 12 which is an inductive conductor and an output line of the amplifier 40 are physically coupled together, it is likely that the electrical field around these elements is disturbed and the impedance at the open end is affected. However, in this embodiment, since the central core 11 is used as an amplifying output signal line, and it passes through the outer sheath 12 which is an inductive conductor, the surrounding electrical field remains undisturbed, and the impedance at the open end is not affected.

More specifically, when the transmission signal in the coaxial line 10 matches in impedance, it is transmitted through the inner surface of the outer sheath 12 and does not interact with the outer side. Also, the exterior current in the outer sheath 12 is transmitted independent from the inner surface of the outer sheath 12.

Furthermore, as to the length of the inductive conductors (which are the parallel conductor 30 and outer sheath 12), $\lambda/4$ is theoretically an optimum length. However, the length of the inductive conductor can vary in wide range in accordance with a distribution volume of the metal plate and the thickness of the conductor and with a stray capacitance of the circuit of the amplifier 40.

In the second embodiment shown in FIGS. 4(1) and 4(2), a coaxial line 10*a*, which is similar to the coaxial line 10 of FIG. 1, is not directly connected to the metal conductor 20. Instead, one end 13*a* of a conductive outer sheath 12*a* which is similar to the outer sheath 12 of FIG. 1 is brought close to the metal conductor 20.

In this case, even when an insulating material, such as paint 21, is applied to the surface of the metal conductor 20, a complete connection is still obtainable without directly contacting the outer sheath to the metal conductor 20. In other words, since the signal transmitted through the outer sheath 12*a* is a high frequency signal, and the outer sheath 12*a* is provided close to the metal conductor 20, a stray capacitance generated between these two elements produces the same effect as they are directly connected.

Accordingly, in the embodiment of FIG. 1, the same result as in the second embodiment can be obtained if the end 13 of the outer sheath 12 is connected to the metal conductor 20 with a condensor provided inbetween, without connecting them directly..

Figures 1, 5:
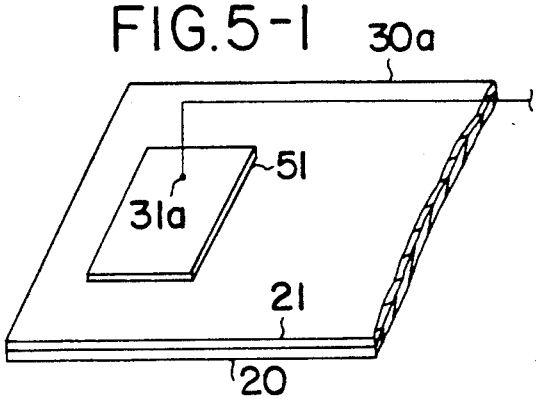
FIGS. 5(1) and 5(2) show yet another embodiment of the present invention.
Figures 2, 5:
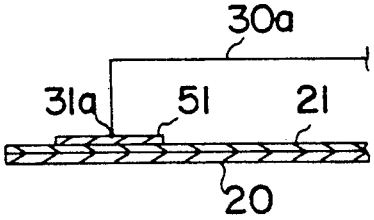

In the embodiment of FIGS. 5(1) and 5(2), one end 31*a* of a parallel conductor 30*a*, which is similar to the parallel conductor 30, is connected directly to a metal plate 51 which is mounted on the metal conductor 20. Reference numeral 21 is paint coated on the metal conductor 20. Though it would depend upon the length of the parallel conductor 30*a*, a large electromotive force is produced when the metal plate 51 is connected to the end of the parallel conductor 30*a* as shown in FIGS. 5(1) and 5(2). Parts such as lumped coils etc. may be used in place of the metal plate 51.

In this embodiment, the relation between the metal plate 51 and metal conductor 20 is a high-frequency connection as in the embodiment of FIG. 4.

Figure 6:
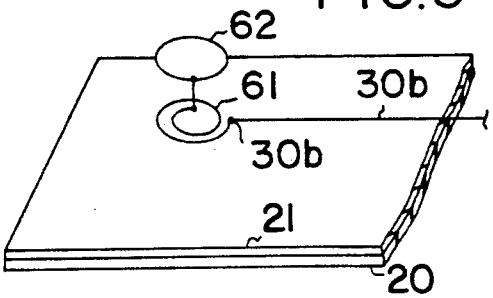
FIG. 6 shows a perspective view of still another object of the present invention.

In the embodiment of FIG. 6, a coil 61 is connected to the end of parallel conductor 30*b* which is similar to the parallel conductor 30. At the end of this coil 61, a metal plate 62 is connected so that the plate 62 is parallel to the surface of the metal conductor 20. A base plate which has a copper foil on each side can be used instead of the coil 61 and the metal plate 62. In this case, etching is applied to one side of the plate so that a coil is provided thereon, while the other side is left intact, and the both sides of the base is connected.

In the above descried embodiments, the coaxial lines 10 and 10*a* may be made from a standard coaxial cable. Also, when it is designed so that an electric current is supplied to the amplifier 40 through the central cores 11 and 11*a* of the coaxial lines 10 and 10*a*, the coaxial line 10 can be used as a signal line as well as an electrical power supply line. Furthermore, a part of vehicle body such as roof can be used as the metal conductor 20.

As mentioned in detail in the above, according to the present invention the FM wave antenna can be mounted flat on a receiver, vehicle body, etc. without projecting.

I claim:

1. An FM wave receiving antenna comprising:

a coaxial line made of a central core and an inductive outer sheath, said coaxial line being provided substantially parallel to a surface of a horizontal metal conductor, and one end of said inductive outer sheath being connected to said metal conductor;

a parallel conductor provided substantially parallel to said metal conductor, one end of said parallel conductor connected to said metal conductor; and an amplifier means having three terminals with a first terminal connected to said inductive outer sheath, a second terminal connected to a second end of said parallel conductor and a third terminal connected to said central core of said coaxial line, said amplifier means amplifying signals from both said parallel conductor and inductive outer sheath of said coaxial line and outputting amplified signals to said central core of said coaxial line.

2. An FM wave antenna according to claim 1, wherein said one end of said inductive outer sheath is directly connected to said metal conductor.

3. An FM wave antenna according to claim 1, wherein said one end of said inductive outer sheath is connected to said metal conductor in a form of high-frequency connection using a capacitance provided between said inductive outer sheath and said metal conductor.

4. An FM wave antenna according to claim 2 or 3, wherein one end of said inductive outer sheath is provided in close proximity to said metal conductor so that distributed capacitance is evenly augmented.

5. An FM wave antenna according to claim 1, wherein said metal conductor is a roof of an automobile.

6. An FM wave antenna according to claim 1, wherein said coaxial line is a coaxial cable, and said outer sheath of said coaxial cable at a point remote from said amplifying means is directly connected to said metal conductor, an other end of said coaxial cable being connected to a receiver.

7. An FM wave antenna according to claim 1, wherein said coaxial line is a coaxial cable, and said outer sheath of said coaxial cable at a point remote from said amplifying means is short-circuited through a low impedance, an other end of said coaxial cable being connected to a receiver.

8. An FM wave receiving antenna according to claim 1, wherein an electric current for said amplifying means is supplied through said central core of said coaxial line so that said central core picks up said amplified signals and also supplies electric current to said amplifying means.

9. An FM wave receiving antenna according to claim 1, further comprising a lumped inductance element provided between said parallel conductor and said metal conductor.

10. An FM wave antenna according to claim 9, wherein said lumped inductance element is a coil.

11. An FM wave antenna according to claim 1, wherein a spiral coil conductor is provided between said parallel conductor and said metal conductor.

12. An FM wave receiving antenna according to claim 1, wherein said one end of said parallel conductor is connected to said metal conductor through a coil and further comprising a metal plate coupled to said one end of said parallel conductor, said metal plate being substantially parallel to the surface of said metal conductor.

* * * * *